US007437863B2

(12) United States Patent
Moser et al.

(10) Patent No.: US 7,437,863 B2
(45) Date of Patent: Oct. 21, 2008

(54) WRAP DISPENSING APPARATUS

(76) Inventors: Robert E. Moser, 2620 42nd Ave. North, St. Petersburg, FL (US) 33714; George E. Morrison, 9428 60th LN, Pinellas Park, FL (US) 33782

( * ) Notice: Subject to any disclaimer, the term of this patent is extended or adjusted under 35 U.S.C. 154(b) by 0 days.

(21) Appl. No.: 11/264,990

(22) Filed: Nov. 2, 2005

(65) Prior Publication Data

US 2007/0095026 A1 May 3, 2007

(51) Int. Cl.
*B65B 11/28* (2006.01)

(52) U.S. Cl. ..... 53/582; 53/592; 53/582; 53/210; 53/219

(58) Field of Classification Search ..... 53/582, 53/588, 219, 399, 430, 218, 592, 390, 556, 53/210
See application file for complete search history.

(56) References Cited

U.S. PATENT DOCUMENTS 4,166,589 A * 9/1979 Hoover et al. ..... 242/423.1
4,369,614 A * 1/1983 Tetzner ..... 53/556
4,409,776 A * 10/1983 Usui ..... 53/399
4,714,211 A * 12/1987 Hwang ..... 242/423.1
5,423,163 A * 6/1995 Wendt ..... 53/556
5,561,971 A * 10/1996 Sampson ..... 53/556
5,673,542 A * 10/1997 Vartanian et al. ..... 53/556
5,779,179 A * 7/1998 Zentmyer et al. ..... 242/423.2
6,470,657 B2 * 10/2002 Huson et al. ..... 53/588
6,526,734 B1 * 3/2003 Huson et al. ..... 53/588
6,739,542 B1 * 5/2004 Prina et al. ..... 242/423.2
6,742,322 B2 * 6/2004 Qicang ..... 53/588
6,883,292 B1 * 4/2005 Chen ..... 53/389.1
6,920,742 B1 * 7/2005 Yu Chen ..... 53/592
7,051,492 B2 * 5/2006 Huson ..... 53/399
2002/0134058 A1 * 9/2002 Huson et al. ..... 53/588
2003/0046908 A1 * 3/2003 Huson et al. ..... 53/588

* cited by examiner

*Primary Examiner*—Rinaldi I. Rada
*Assistant Examiner*—Gloria R. Weeks
(74) *Attorney, Agent, or Firm*—David Kiewit

(57) ABSTRACT

A wrap dispensing apparatus for wrapping an article with wrapping material includes a base; a hub assembly; a threaded spindle mounted to the base and the hub assembly, and a brake assembly to control the movement of the threaded spindle. The threaded spindle supports a roll of material between the base and the hub assembly. Further included is a steering arm that is attached to the base and the hub assembly and spaced from the threaded spindle. The base has wheels for omni-directional movement along a horizontal surface.

13 Claims, 6 Drawing Sheets

WRAP DISPENSING APPARATUS

BACKGROUND OF THE INVENTION

1. Field of the Invention

The present invention relates to a wrap dispensing apparatus and more particularly pertains to mobile wrapping apparatus for wrapping material about a load or items to be banded.

2. Description of the Related Art

The use of portable film wrapping systems is known in the prior art. More specifically, film wrapping systems heretofore devised and utilized for the purpose of wrapping film about a load carried on a pallet are known to consist basically of familiar, expected and obvious structural configurations, notwithstanding the myriad of designs encompassed by the crowded prior art which have been developed for the fulfillment of countless objectives and requirements.

In the stretch wrapping of loads carried on pallets, a sheet of material is spirally wrapped about the load on the pallet. By way of example, the prior art includes U.S. Pat. No. 6,742,322, which has a portable plastic film wrapping system that includes a pushcart with a vertical mast mounted on the push cart. The film roll carriage is moved vertically along the mast and the film roll carriage is operatively connected to a counter weight.

U.S. Pat. No. 6,742,322, is a portable plastic film wrapping system that includes a push-cart having a vertical mast member mounted thereon. A film roll carriage is vertically movable along the mast member, and the film roll carriage is operatively connected to a counterweight which is movably disposed within the mast member. The mast member is provided with a plurality of apertures, and a redundant dual stop pin assembly is engageable within particular ones of the mast member apertures so as to incrementally lockingly retain the film roll carriage at a particular elevations along the mast member such that safe controlled movement of the film roll carriage along the mast member is achieved.

U.S. Pat. No. 6,526,734, is a portable plastic film wrapping system that comprises a push-cart having a vertical mast member mounted thereon. A film roll carriage is vertically movable along the mast member, and the film roll carriage is operatively connected to a counterweight which is movably disposed within the mast member. The mast member is provided with a plurality of apertures, and a releasable stop pin is engageable within a particular one of the mast member apertures so as to lockingly retain the film roll carriage at a particular elevation when concentric reinforcing wrapping of an article is desired, and is disengageable from the apertures so as to permit the film roll carriage to continuously elevate for spiral wrapping of the article.

U.S. Pat. No. 6,470,657, is a portable film wrapping system that comprises a push-cart having a vertical mast member and a film roll carriage movably mounted upon the vertical mast member. A lift cable connects the film roll carriage to a lift cable drum which is rotatably connected to a lift sprocket through a clutch mechanism, wherein the lift sprocket is rotatably connected to a drive wheel engaged with a floor surface over which the portable system is movable. When the clutch mechanism operatively connects the lift cable drum to the lift sprocket, the lift cable drum is rotated so as to wind the lift cable thereon and thereby continuously elevate the film roll carriage whereby spiral wrapping is achieved. When the clutch mechanism disconnects the lift cable drum from the lift sprocket, the lift cable is no longer wound upon the lift cable drum whereby the film roll carriage is maintained at a particular elevation so as to achieve concentric reinforcing wrapping.

Lastly, U.S. Pat. No. 4,369,614, is an apparatus for wrapping a load carried on a floor-mounted pallet. The apparatus includes a carriage having a wheeled base for rolling movement about the pallet-carried load. The carriage is provded with an upright upstanding from the base and vertically movably supporting a carrier assembly for a roll of wrapping sheet material. A handle structure is provided on the carriage for manipulation of the carriage in effecting the rolling movement about the pallet-carried load and mechanism is provided adjacent the handle for effecting vertical movement of the carrier assembly to permit spiral wrapping of the sheet material about the pallet-carried load. The carrier assembly is arranged to extend downwardly to a lowermost position, permitting wrapping of the pallet substantially at floor level and, in an uppermost position, for wrapping the uppermost portion of the load. The apparatus of the '614 patent further includes improved structure for releasably retaining the sheet material roll on a spindle on the carrier assembly.

In accordance with a second one of such manual methods of applying a stretch film to such palletized loads or products, as illustrated, for example, within U.S. Pat. No. 5,458,841 which issued to Shirrell on Oct. 17, 1995, and in lieu of directly holding or grasping the film roll, the operator holds or grasps a film roll dispensing or holding device which has a built-in tensioning mechanism. In accordance with either one of the afore-noted modes, methods, or manners in which stretch film is applied manually to the palletized products or loads, several operational drawbacks or disadvantages common to both methods or modes were apparent. Firstly, for example, the film roll, or the film roll and film roll dispensing or holding device, must be supported by the operator personnel, and yet the film roll and the film roll dispensing or holding device are quite heavy and cumbersome. In addition, in order to fully wrap a palletized load, the operator must bend down while holding the film roll, or the film roll and film roll dispensing or holding device, in order to wrap the film around the lower extremity portions of the palletized loads or products. Such requirements upon the operator personnel have been noted to cause acute discomfort, fatigue, and stress-related injuries. In addition, the operators experience fatigue and discomfort even when the operators are wrapping the upper regions of the palletized loads or products due to the continuous need for supporting the entire weight of the film roll, or the film roll and film roll dispensing or holding device.

Therefore, it can be appreciated that there exists a continuing need for a new and improved wrap dispensing apparatus which can be used for warping palletized loads or products that is easier to maneuver and reduces operator fatigue and discomfort. In this regard, the present invention substantially fulfills this need.

SUMMARY OF THE INVENTION

The present invention provides an apparatus for wrapping material around pallets or any items to be banded together.

Accordingly, a primary object of the wrap dispensing apparatus is to allow for the easy wrapping of material around a load on a pallet or article to be bound with maximum control and the least amount of physical exertion. As such, the general purpose of the present invention, will be described subsequently in greater detail.

To attain this, the present invention essentially is a wrap dispensing apparatus for wrapping the pallet or articles with wrapping material. The apparatus has a base, a hub assembly and a threaded spindle. The threaded spindle is rotatably mounted to the base and the hub assembly to allow rotation of the roll of material about the threaded spindle. The threaded spindle has a roll of wrapping material mounted thereon via the core. Included is a steering arm that has a lower portion attached to the base and an upper portion attached to the hub assembly. Further, the base has wheels for omni-directional movement along a horizontal surface. The base is moved relative to the horizontal surface with the pulling or pushing of the steering arm. When the wheels of the base are rotatably moved along the horizontal surface around articles to be bound, the roll of material undergoes vertical movement along the threaded spindle. The vertical movement of the roll about the threaded spindle enables the articles to be wrapped within said wrapping material.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Accordingly, it is an object of the present invention to provide a new and improved apparatus or system for applying wrapping or packaging film to palletized loads or products.

It is therefore an object of the present invention to provide a new and improved wrap dispensing apparatus which has all the advantages of the prior art film wrapping systems and none of the disadvantages.

Another object of the present invention is to provide a new and improved wrap dispensing apparatus which may be easily and efficiently manufactured and marketed.

A further object of the present invention is to provide a new and improved wrap dispensing apparatus which is of a durable and reliable construction that is easily assembled.

An even further object of the present invention is to provide a new and improved wrap dispensing apparatus which allows the load on the pallet to be easily wrapped without manual adjustment of the roll along the threaded spindle.

Still yet another object of the present invention is to provide a new and improved wrap dispensing apparatus which provides in the apparatuses a braking system that stops rotating movement of the threaded spindle coupled between the base and the hub assembly.

Still another object of the present invention is to provide a carrier assembly for the roll of material on the threaded spindle that moves the roll of material along the threaded spindle when the brake has engaged the treaded spindle and as the apparatus is moved around the load on the pallet or articles to be bound.

Yet another object of the present invention is to provide an apparatus that has controls that allow adjustment in tension on the film being wrapped and can select between translating while unwinding and not translating while winding and can select between unwinding and not unwinding.

Another object of the present invention is to provide a steering arm that is easily used to guide the apparatus around the load on the pallet or the article to be bound.

An additional object of the present invention is to provide a new and improved apparatus or system for applying wrapping or packaging film to palletized loads or products wherein the wrapping or packaging film can be applied to or wrapped around the palletized loads or products by means of operator personnel who can simply walk around the pallet upon which the loads or products are disposed and simultaneously push or guide the roll of wrapping film around the palletized loads or products whereby the palletized loads or products are accordingly packaged or wrapped within such wrapping film.

A further object of the present invention is to provide a new and improved apparatus or system for applying wrapping or packaging film to palletized loads or products wherein the wrapping or packaging film can be applied to or wrapped around the entire vertical extent of the palletized loads or products by means of operator personnel who need not support the weight of the film roll, or the film roll and the film roll dispensing mechanism, and in addition need not bend down in order to wrap or apply the stretch film upon or to the lower extremity portions of the palletized loads or products.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
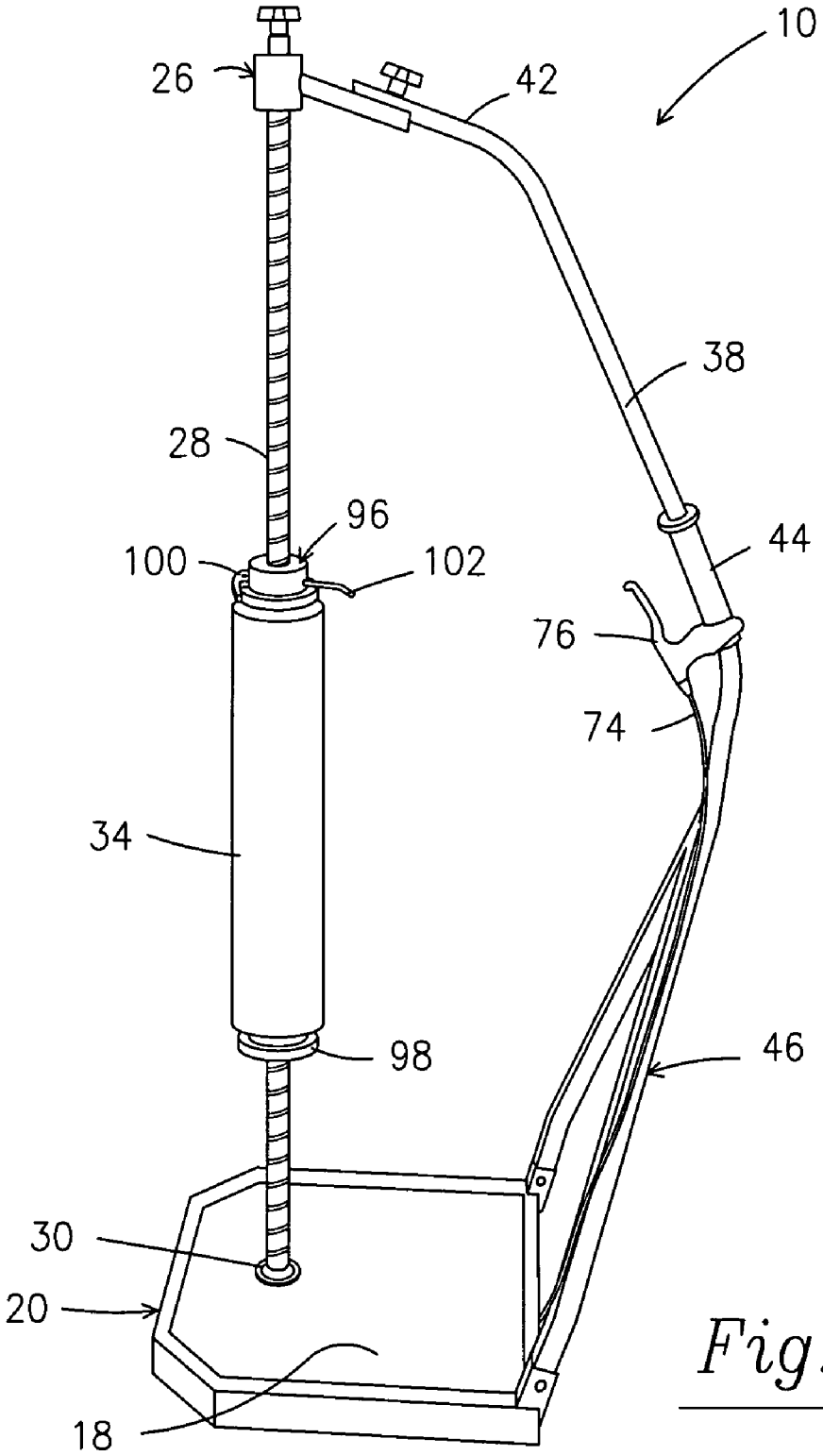
FIG. 1 is a perspective illustration of the preferred embodiment of the wrap dispensing apparatus constructed in accordance with the principles of the present invention.

With reference now to the drawings, and in particular to FIGS. 1-7 thereof, a wrap dispensing apparatus 10 embodying the principles and concepts of the present invention and generally designated by the reference numeral 10 will be described.

The present invention, the new and improved wrap dispensing apparatus, is comprised of a plurality of components. Such components in their broadest context include a base, a hub assembly, a steering arm, a threaded spindle and a brake assembly. Such components are individually configured and correlated with respect to each other so as to attain the desired objective.

More specifically, the present invention is a wrap dispensing apparatus for wrapping an article with wrapping material. The apparatus of FIG. 1 includes a base 20 that is made of a rigid material. A hub assembly 24 is coupled to a threaded spindle 28 that has a lower end positioned within the upper bearing 30 mounted onto the base. The threaded spindle can be rotated when it is positioned within the upper bearing. The threaded spindle when mounted to the base and the hub assembly is capable of supporting a roll 34 of material between the base and the hub assembly. In order to maneuver the apparatus, a steering arm 38 is attached to the base, and said hub assembly. The steering arm is spaced from the threaded spindle. This will ensure that maneuvering the apparatus with the steering arm will not interfere with wrapping the material around the pallet load or product. Further, the base has wheels 40 for omni-directional movement of the apparatus along a horizontal surface.

It is important that the threaded spindle is able to rotate within the base and the hub assembly. The rotation of the threaded spindle prevents the spool 34 of material from travel up the threaded spindle 28 as the apparatus is moved around the pallet load for material wrapping of the load, and allows for multiple layers of the film to be wrapped about the same location of the item(s) to be wrapped. Further, in another instance it is important for the threaded spindle 28 to be frozen in position between the base and the hub assembly. This non-movement of the threaded spindle in this instance allows the spool of the material to travel up the threaded spindle as the apparatus is moved around the pallet load for material wrapping of the load and tension on the film as it is unwrapped from the spool causes the spool to spin which causes the spool to translate up along the threaded spindle.

Figure 2:
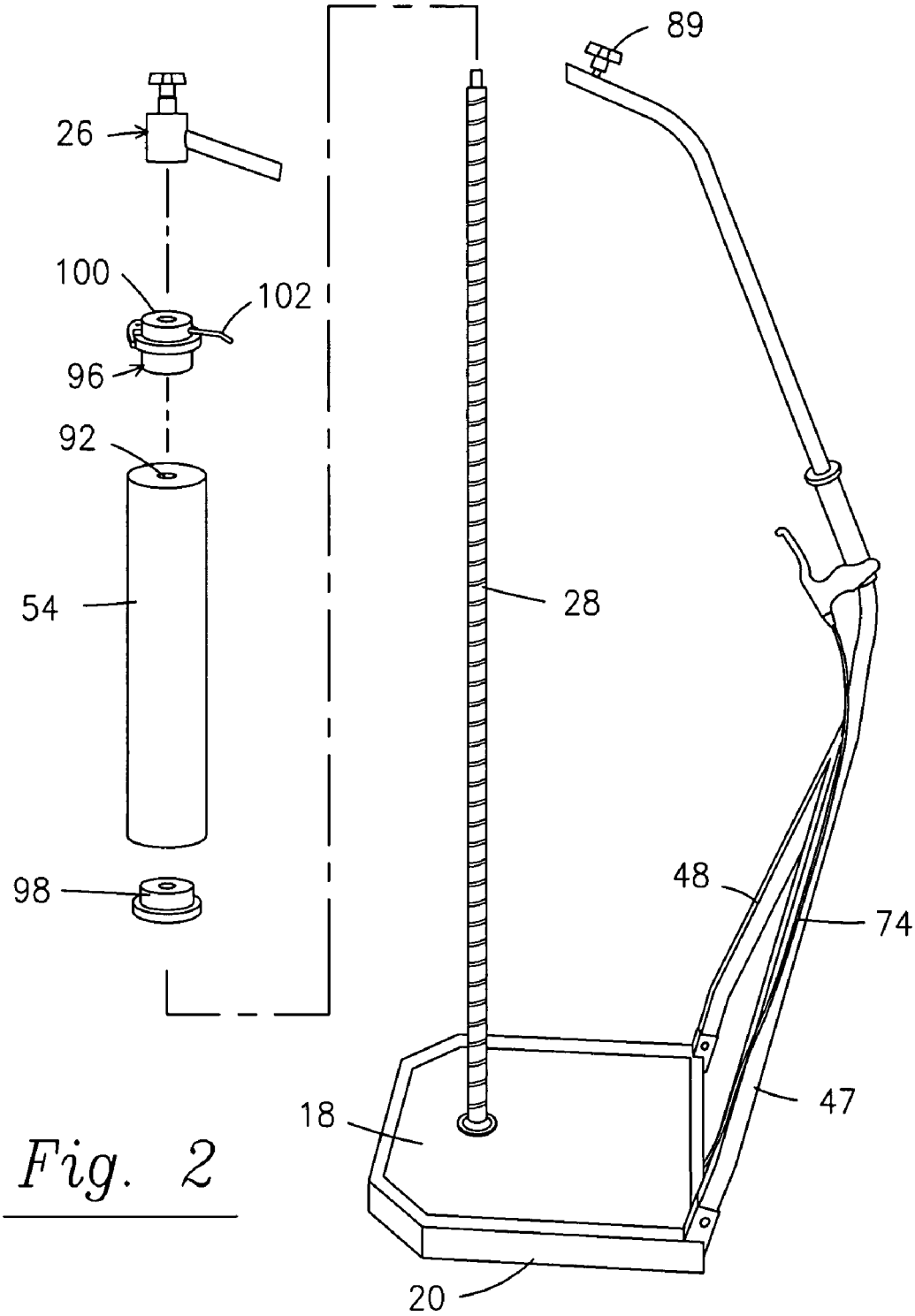
FIG. 2 is an exploded view of the apparatus of FIG. 1 with out showing the brake assembly.

Additionally, the steering arm 42 has an upper portion mounted to the hub assembly 24, a handle portion 44 and a lower portion 46, as shown in FIG. 1. The lower portion is formed by a pair of leg members 47 and 48, as shown in FIG. 2, with the pair of leg members attached to opposite ends of the base 20. The leg member structure increases the stability of the apparatus and reduces the likelihood of the apparatus tipping as it is moved around the pallet load or product.

The handle portion of the steering arm is pulled or pushed to move the base 20 relative to the horizontal surface. When the handle portion is pushed or pulled, the base is moved along the horizontal surface around an article. As the apparatus is moved around the article material on the roll of material will be wrapped around the article as the roll undergoes vertical movement along the threaded spindle 28.

Figure 4:
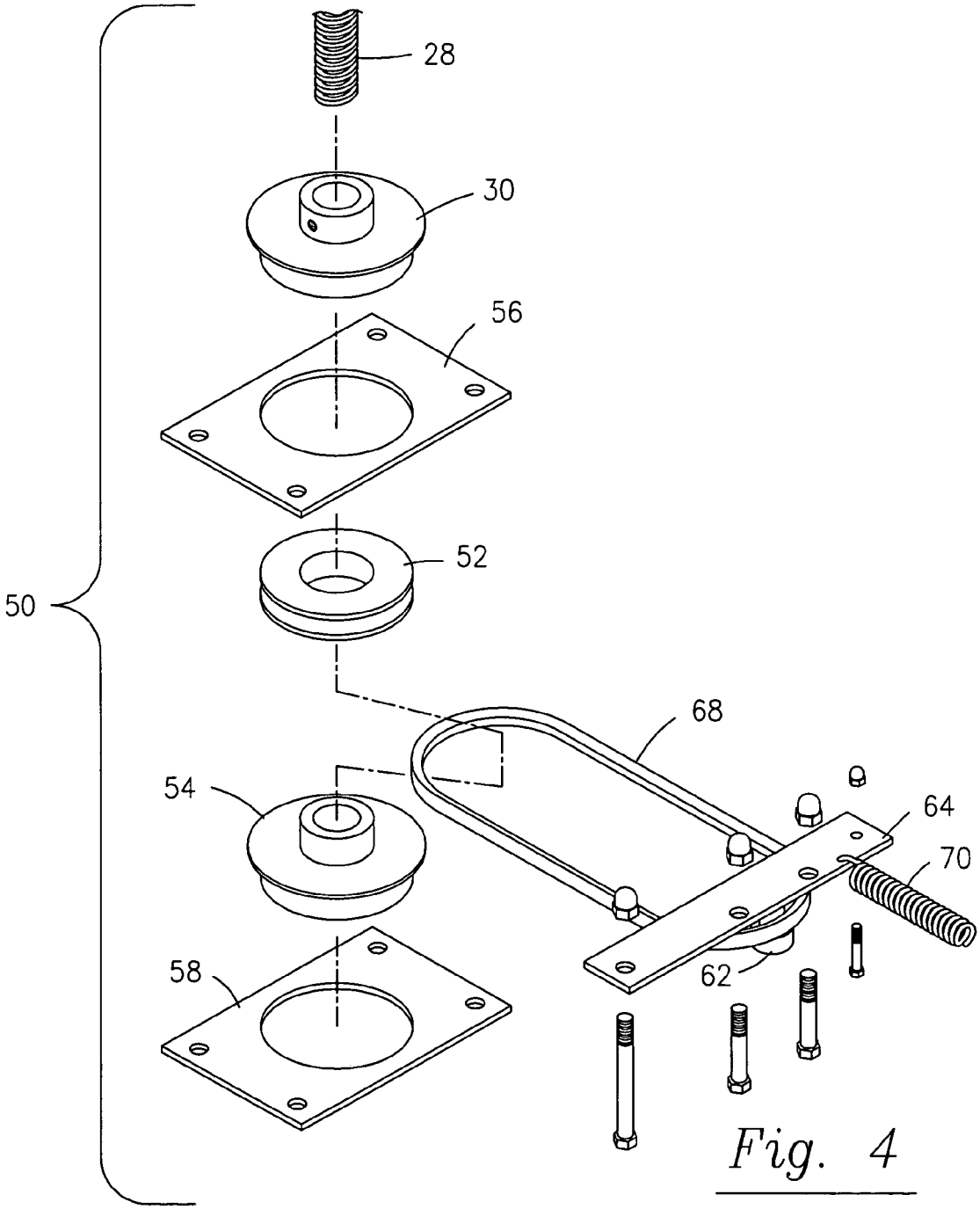
FIG. 4 is an exploded view of the brake assembly.
Figure 5:
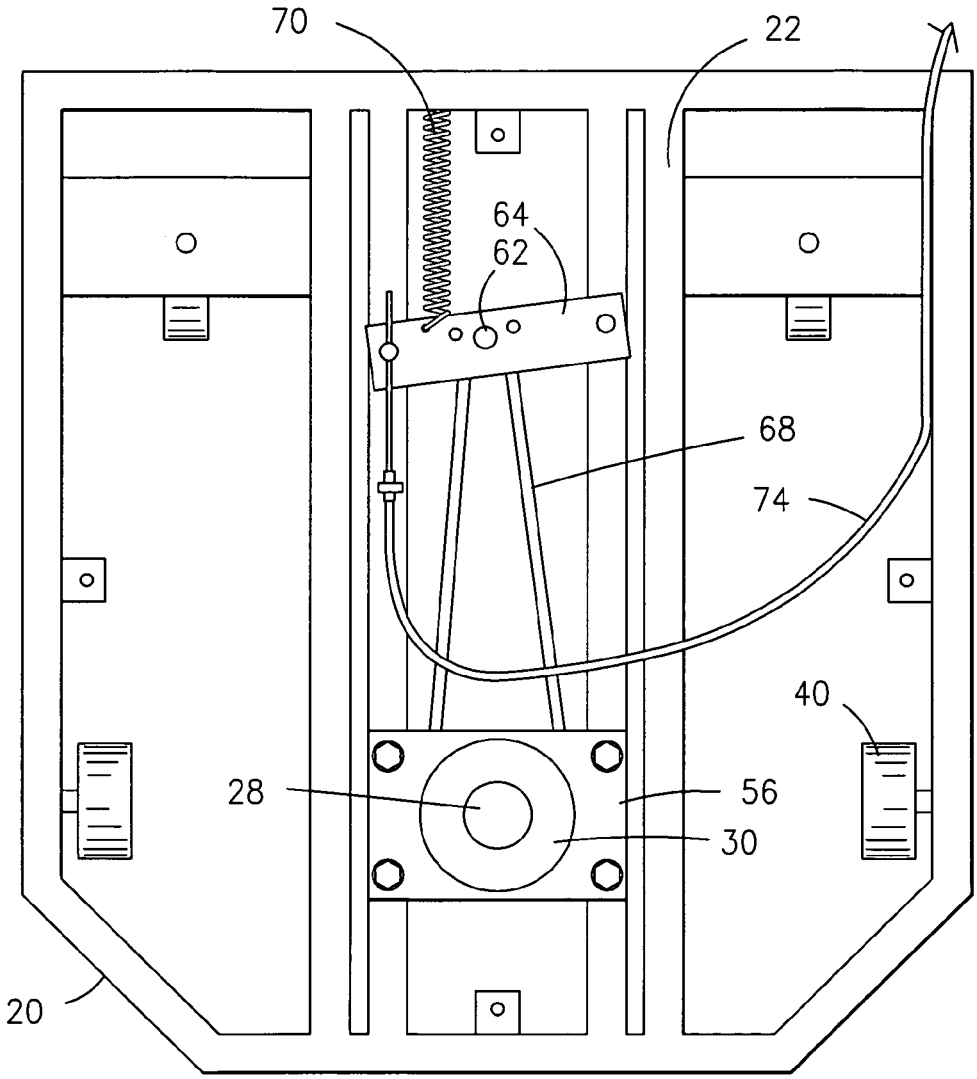
FIG. 5 is a top view of the brake assembly attached to the base.

In order to control the rotating movement of the threaded spindle 28 a brake assembly 50 is connected to the threaded spindle. The brake assembly, as shown in FIGS. 4 and 5, is mounted to the center frame portion 22 of the base 20. By having the brake assembly control the movement of the threaded spindle, the vertical movement of the roll of material along the threaded spindle is controlled. The brake assembly includes a brake 52. The brake is interconnecting with an upper bearing 30 and a lower bearing 54 and seats between the upper bearing and the lower bearing. The upper bearing and the lower bearing each having a bearing plate for mounting to the base. The upper bearing plate 56 is positioned against the top side of the center frame portion of the base and the lower bearing plate 58 is positioned against the bottom side of the center frame portion of the base. The upper and lower bearing plates are mounted to the base and secure the upper bearing, lower bearing and brake in position on the base, as best illustrated in FIG. 5.

FIGS. 4 and 5, show a sheave 62 is attached to a sheave plate 64 which is mounted to the base 20. A belt 68 is simultaneously coupled to the brake and the sheave. The diameter of the belt is such that when the brake is in a resting position, the belt is under enough tension to remain simultaneously around the sheave and the brake. Included is a spring 70. One end of the spring is coupled with the sheave plate 64 and another end of the spring is coupled to center frame portion of the base 20 near the rear, as best illustrated in FIG. 5. The threaded spindle is engagedly coupled with the upper bearing, the brake and the lower bearing.

Brake operation is controlled by a cable 74, as depicted in FIGS. 1, 2 and 5. The cable is interconnected with a brake lever 76 at one end and latched to the sheave plate 64 at another end. The brake lever is coupled to the handle portion 44 of the steering arm 38. The brake cable operates like all standard cable brakes. Specifically, with brake lever being pressed toward the handle, the cable pulls the sheave plate back and forth to pull the sheave back and forth. This movement of the sheave increases and decreases the tension on the belt to engage and disengage the brake 52, thereby controlling the movement of the threaded spindle when mounted between the base and hub assembly 24. A base cover plate 18 can be mounted to the base to hide the brake assembly. In the preferred embodiment, to control the movement of the threaded spindle, the apparatus, uses a belt 68, sheave 62, sheave plate 64, spring 70, and a brake (pulley wheel) 52 to act as the brake mechanism, there are numerous methods that can accomplish the same action. These methods include but are not limited to a disc brake assembly, a brake shoe and pad assembly or an electric brake assembly. Any one of these can be use to prevent or allow the rotation of the threaded spindle around its central axis.

Figure 3:
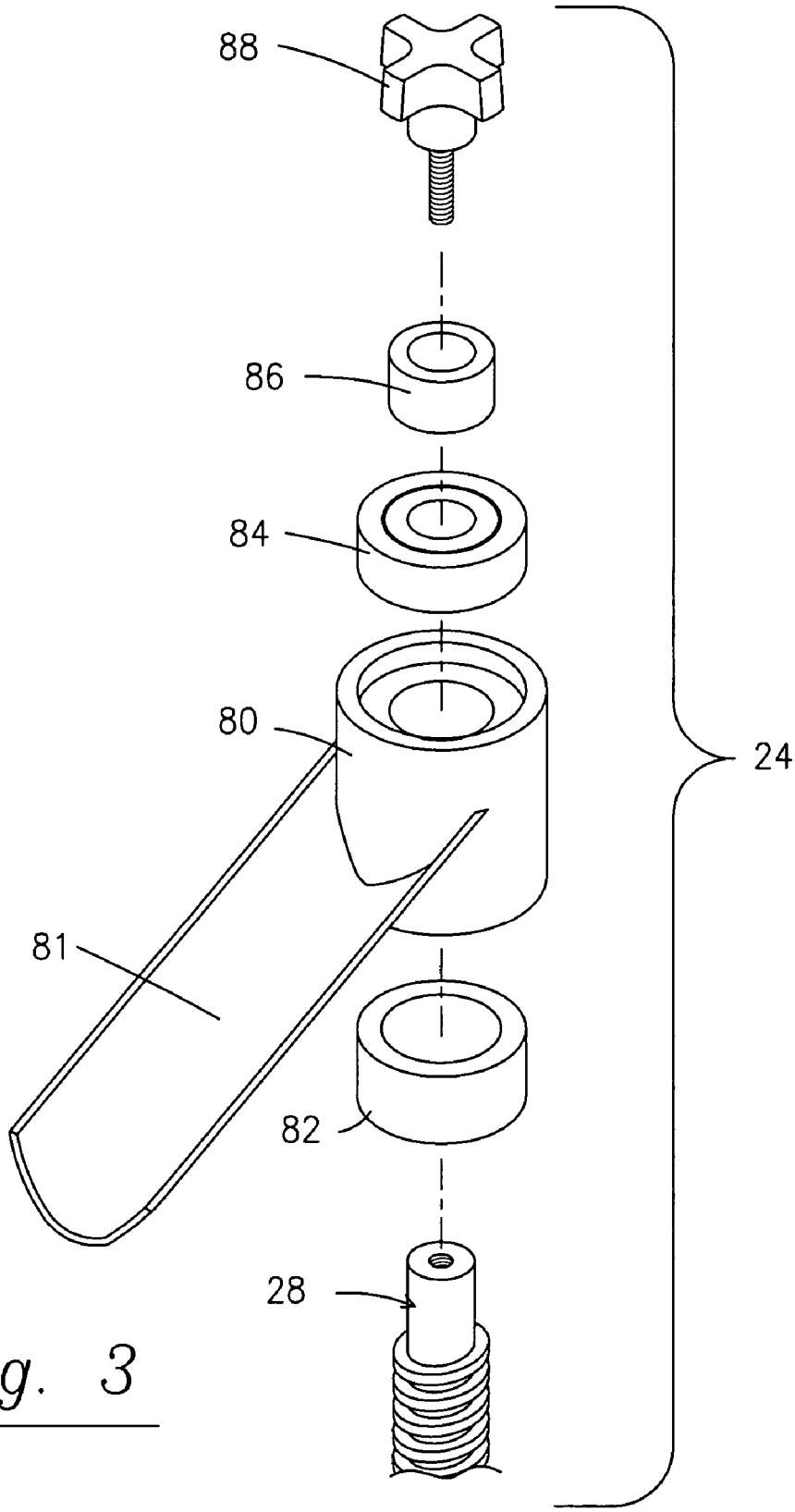
FIG. 3 is an exploded view of the hub assembly.

The hub assembly 24, of FIG. 3, secures the threaded spindle and the steering arm in position above the base. The hub assembly includes a stabilizer hub 80 that is seated on a guide 82 for the threaded spindle. A stabilizer hub bearing 84 is positioned within the stabilizer hub. The hub assembly is fastened onto the threaded spindle with a knob 88. The knob has a washer 86 and secures the hub assembly to the threaded spindle during the placement and removal of roll 34 of material. Tightening and releasing the knob allows the hub assembly to be removed for roll placement and removal; and repositioned on the threaded spindle after the requisite action on the roll. Furthermore, the stabilizer hub has an arm rest 81 that is sized to receive the upper portion 42 of the steering arm 38. A second stabilizer knob 89, as shown in FIG. 2, is used to secure the steering arm to the hub assembly.

Figure 6:
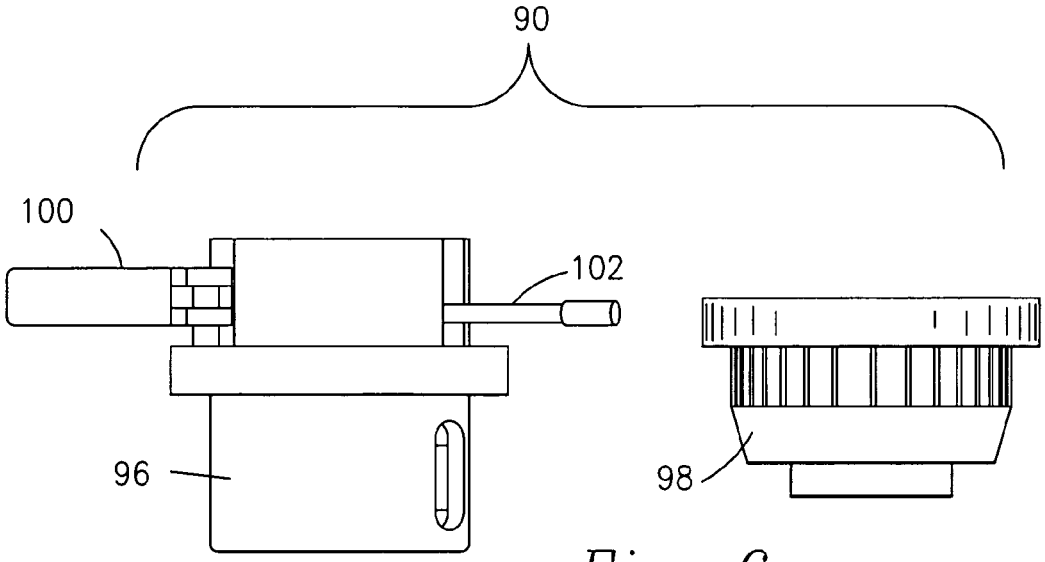
FIG. 6 is a side view of the components of the carrier assembly.
Figure 7:
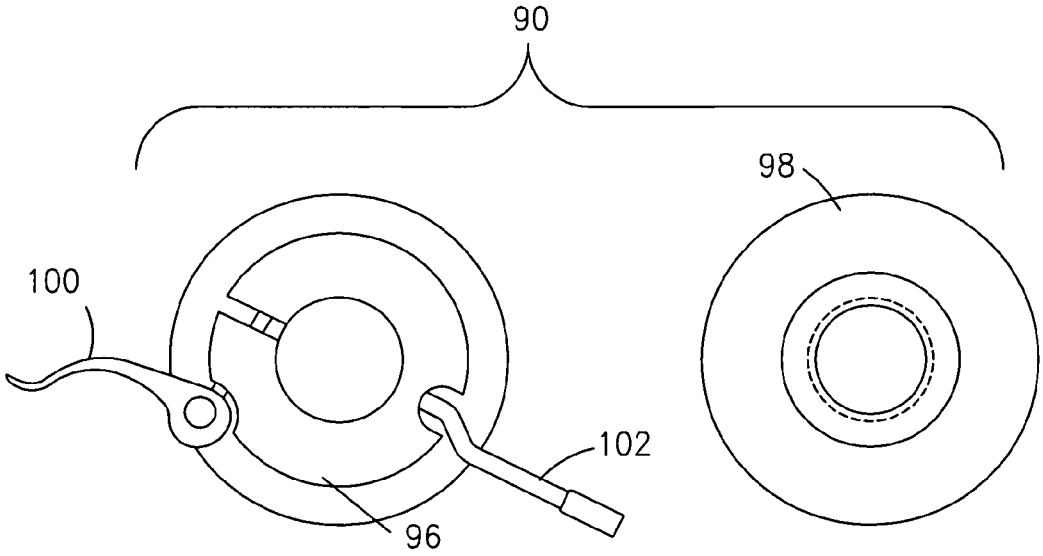
FIG. 7 is a top view of the components of the carrier assembly.

A carrier assembly 90, as shown in FIGS. 6 and 7, helps the roll of material move up and down the threaded spindle 28. The carrier assembly carries the core 92 of the roll (spool) of wrapping material vertically along the threaded spindle. The carrier assembly includes an upper spool hub 96 and a lower spool hub 98, each of which has internal threads. Specifically, the rate of vertical movement of the roll/spool is controlled by the friction of the lower spool hub against the threaded spindle and the rate at which the operator pulls or pushes the apparatus relative to the horizontal surface around the pallet of items to be wrapped.

In the preferred embodiment the apparatus operates with the lower spool hub 98 being the only threaded spool hub, and the upper spool having a smooth interior core, as shown in FIG. 7. The upper spool hub and said lower spool hub simultaneously engage the core of said roll of wrapping material, as shown in FIG. 1. The upper spool hub is positioned juxtapose a first end of the core of the roll of material and threadably engages the threaded spindle. The lower spool hub is positioned juxtapose a second end of the roll of material and threadeably engages the threaded spindle. Whereas when the base 20 is moved along the horizontal surface and the material on the roll of material is wrapped around the article, and while maintaining film tension, the upper spool hub 96 and the lower spool hub 98 undergo simultaneous vertical movement along the threaded spindle. This movement of the upper spool hub and the lower spool hub coaxially carry the roll of wrapping material from a lowermost position about the threaded spindle to an uppermost position about the threaded spindle when the threaded spindle is engaged by the brake. The upper spool hub includes a hub tensioner 100 and a cam lever 102, as shown in FIGS. 6 and 7. The hub tensioner secures the upper spool hub in position about the threaded spindle and prevents the roll of material from moving freely along the threaded spindle. In one mode of operation the friction created by the lower spool hub 98 and the tensioner 100 of the upper spool hub 96 will prevent the carrier assembly from translating upward and the apparatus would be in a multi-layer wrapping mode at the current level of the core of the roll of material relative to the vertical limit of the threaded spindle.

Succinctly described, the apparatus is a portable film-wrapping system which has an omni-directional cart with a vertical lead screw (threaded spindle) mounted between two lower, flanged bearings and an upper pressed bearing in a housing mounted to the center frame portion 22. The film spool (roll) rides the threaded spindle through the lower film spool hub 98 and the upper film spool hub 96 as the tensioner keeps it in place. The vertical movement of the film spool is controlled by the carrier assembly acting against the treaded spindle 28 and the rate at which the operator pulls or pushes the apparatus. During such operation with the use of a V-belt and pulley brake system 50 affixed to the threaded spindle and mounted between the upper & lower flanged bearing housings, the brake is engaged to keep the threaded spindle stationary. Brake tension is set to normal via the brake tension spring 70, allowing the film spool to rise vertically as the tension of the film wrap attached to a fixed object causes the film spool to revolve around the lead screw, which is held stationary in the base and hub assembly by the brake. Brake tension is released through the use of a hand activated brake lever that is fastened on to the stabilizer steering arm and controls the brake cable. Anytime the brake is released the lead screw acts as a free axle freely rotating around its center axis and causing the film spool to unwind without rising, thereby allowing for multiple wraps at any level during the wrapping process. Once the film spool has reached the apex of vertical travel, cutting the film wrap between the fixed object and the film spool and releasing the upper film spool hub tensioner, allows the film spool to free fall slowly through friction between the lead screw and lower spool hub, to the base or starting position. Re-tightening the upper film spool hub tensioner 100, places the device back in to the normal operating mode.

In operation, a full roll of film wrap is installed onto the apparatus. The film wrap, on a roll 34, is slid down over the top of the threaded spindle and onto the film spool lower threaded hub 98. Then the upper spool hub is slid over the threaded spindle and down into the core of the film spool. The inner core quick release is locked with the cam lever 102 and the tensioner quick release is adjusted for the desired tension on the film wrap. Prior to the above acts, the lower spool hub (threaded) should be resting on the base 20 of the apparatus. Next, the user will unwrap a length of film wrap suitable for attaching the free end of the film wrap to the material to be wrapped and attach the free end of the film wrap to the lower corner of the material to be wrapped. The user then pulls or pushes the apparatus, circling the material to be wrapped as many times as necessary to achieve the level and density of wrapping desired.

During operation the upward travel of the spool/roll may be halted at any point during the wrapping cycle by pulling the brake release handle inwards toward the stabilizer and steering arm assembly in order to pull the sheave plate towards the sheave, which releases tension on the brake belt allowing the threaded spindle 28 to turn freely. Releasing the brake release handle causes the sheave plate to retract, thereby applying tension to the sheave via the sheave belt. This, in turn, will cause the threaded spindle to remain stationary, and allow the spool/roll to climb the threaded spindle as the carrier assembly 90 rotates about the threads of the threaded spindle. Engaging the brake will allow upward travel of the film wrap spool to continue. Once wrapping is complete, the wrap is severed from the spool and attached to the material that was wrapped. Lastly, the tension on the upper spool hub is released so that the film wrap spool will free fall to the base of the apparatus and be ready to commence wrapping again.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, equitably entitled.

What is claimed:

1. A wrapping material dispensing apparatus for wrapping an article, the apparatus comprising:

a base having wheels for omni-directional movement along a horizontal surface;

a hub assembly;

a threaded spindle rotatably mounted between the base and the hub assembly and capable of supporting a roll of the wrapping material so as to allow rotation of the roll of the wrapping material thereabout;

a steering arm attached to the base and to the hub assembly, the steering arm spaced from the threaded spindle, the steering arm comprising an upper portion mounted to the hub assembly and a lower portion formed by a pair of leg members respectively attached to opposite ends of the base member; and a brake assembly mounted on the base to control rotatable movement of the threaded spindle; the brake assembly comprising:

a brake interconnecting with an upper bearing and a lower bearing, the upper bearing and the lower bearing each having a respective bearing plate for mounting to the base;

a sheave attached to a sheave plate mounted to the base;

a belt simultaneously coupled to the brake and the sheave; and a spring having one end coupled to the sheave plate and another end coupled to the base;

wherein the threaded spindle has a lower end engagedly coupled to the upper bearing, the brake and the lower bearing so that rotational movement of the threaded spindle is controlled by the movement of the upper bearing.

2. The wrapping material dispensing apparatus as set forth in claim 1, further comprising:

a cable interconnected with a brake lever at one end and latched to the sheave plate at another end, the brake lever coupled to the handle portion of the steering arm;

wherein the cable is capable of pulling the sheave plate back and forth with respect to the sheave for increasing and decreasing tension on the belt to control movement of the threaded spindle.

3. The wrapping material dispensing apparatus as set forth in claim 1 wherein the hub assembly comprises:

a stabilizer hub seated on a guide for the threaded spindle;

a stabilizer hub bearing positioned within the stabilizer hub;

a knob for securing the hub assembly to the threaded spindle during placement and removal of the roll of the wrapping material; and a stabilizer knob for securing the steering arm to the hub assembly.

4. The wrapping material dispensing apparatus as set forth in claim 1 further comprising:

a carrier assembly for carrying a core of the roll of the wrapping material vertically along the threaded spindle;

the carrier assembly comprising an upper spool hub and a lower spool hub, arranged so that the upper spool hub and the lower spool hub simultaneously engage the core of the roll of the wrapping material.

5. The wrapping material dispensing apparatus as set forth in claim 4 wherein:

the upper spool hub is disposed adjacent a first end of the core of the roll of the wrapping material and threadably engages the threaded spindle; and the lower spool hub is disposed adjacent a second end of the roll of the wrapping material and threadably engages the threaded spindle;

so that when the brake engages the threaded spindle to prevent rotational movement thereof and the base is moved along the horizontal surface to dispense the wrapping material from the roll thereof the upper spool hub and the lower spool hub undergo simultaneous vertical movement along the threaded spindle coaxially carrying the roll of the wrapping material from a lowermost position about the threaded spindle to an uppermost position about the threaded spindle.

6. A wrapping material dispensing apparatus for wrapping an article with the wrapping material, the wrapping material dispensing apparatus comprising:

a base;

a hub assembly;

a threaded spindle rotatably mounted to the base and the hub assembly, the threaded spindle capable of having a roll of the wrapping material mounted thereon;

a brake assembly mounted on the base, the brake assembly selectively engaging or disengaging the threaded spindle to control movement of the threaded spindle;

a steering arm having a lower portion attached to the base and an upper portion attached to the hub assembly; and the base having wheels for omni-directional movement along a horizontal surface so that the base is capable of being moved relative to the horizontal surface to allow the wrapping material to be dispensed from the roll;

wherein when the brake assembly disengages from the threaded spindle and the wheels of the base are moved along the horizontal surface around an article, the roll of wrapping material moves about the threaded spindle so as to enable the article to be wrapped within the wrapping material at a current level of the roll of the wrapping material.

7. The wrapping material dispensing apparatus as set forth in claim 6 wherein said brake assembly comprises:

a brake interconnecting with an upper bearing and a lower bearing; said upper bearing and said lower bearing each having a respective bearing plate for mounting to said base;

a sheave attached to a sheave plate; mounted to said base;

a belt simultaneously coupled to said brake and said sheave; and a spring having one end coupled to said sheave plate and another end coupled to said base wherein said threaded spindle is engagedly coupled with said upper bearing, said brake and said lower bearing for control of the rotational movement of said threaded spindle.

8. The wrapping material dispensing apparatus as set forth in claim 7, and further comprising;

a cable interconnected with a brake lever at one end and latched to said sheave plate at another end, said brake lever coupled to said handle portion of said steering arm;

wherein said cable is capable of pulling said sheave plate back and forth with respect to said sheave for increasing and decreasing tension on said belt to control the movement of said threaded spindle.

9. The wrapping material dispensing apparatus as set forth in claim 6, wherein said hub assembly comprises:

a stabilizer hub seated on a guide for the threaded spindle;

a stabilizer hub bearing positioned within said stabilizer hub;

a knob for securing said hub assembly to said threaded spindle during the placement and removal of said roll of material; and a stabilizer knob for securing said steering arm to said hub assembly.

10. The wrapping material dispensing apparatus as set forth in claim 6 and further comprising:

a carrier assembly for carrying a core of the roll of wrapping material vertically along the threaded spindle;

the carrier assembly comprising an upper spool hub and a lower spool hub, wherein the upper spool hub and the lower spool hub simultaneously engage the core of the roll of the wrapping material.

11. The apparatus as set forth in claim 10 wherein:

said upper spool hub is adjacent a first end of said core of said roll of material and threadably engages said threaded spindle;

said lower spool hub is adjacent a second end of said roll of material and threadably engages said threaded spindle;

so that when said base is moved along said horizontal surface and said wrapping material is wrapped around said article, said upper spool hub and said lower spool hub undergo simultaneous vertical movement along said threaded spindle coaxially carrying said roll of wrapping material from a lowermost position about the threaded spindle to an uppermost position about the threaded spindle.

12. A wrapping material dispensing apparatus for wrapping an article with the wrapping material, the apparatus comprising:

a threaded spindle mounted between a base and a hub assembly, said threaded spindle supporting a roll of the wrapping material between said base and hub assembly; said threaded spindle allowing rotation of said roll of material about said threaded spindle and translation of said roll of material along said threaded spindle;

a carrier assembly for carrying a core of said roll vertically along said threaded spindle;

a steering arm attached to said base and to said hub assembly, said steering arm being spaced from said threaded spindle;

a brake assembly mounted on said base for controlling movement of said threaded spindle;

wherein said base has wheels for omni-directional movement along a horizontal surface to allow the material to be dispensed from said roll thereof; and wherein the hub assembly comprises:

a stabilizer hub seated on a guide for the threaded spindle;

a stabilizer hub bearing positioned within the stabilizer hub;

a knob for securing the hub assembly to the threaded spindle during the placement and removal of the roll of the material; and a stabilizer knob for securing the steering arm to the hub assembly.

13. The wrapping material dispensing apparatus as set forth in claim 12 wherein said brake assembly comprises:

a brake interconnecting with an upper bearing and a lower bearing, said upper bearing and said lower bearing each having a respective bearing plate for mounting to said base;

a sheave attached to a sheave plate; said sheave plate mounted to said base;

a belt simultaneously coupled to said brake and said sheave;

a spring having one end coupled to said sheave plate and another end coupled to said base;

a cable interconnected with a brake lever at one end and latched to said sheave plate at another end, said cable capable of pulling said sheave plate back and forth with respect to said sheave for increasing and decreasing tension on said belt to control movement of said threaded spindle;

wherein said threaded spindle has a lower end engagedly coupled with said upper bearing, said brake and said lower bearing; and wherein rotational movement of said threaded spindle is controlled by the movement of said upper bearing.

* * * * *